US009199502B2

(12) United States Patent
Degott et al.

(10) Patent No.: US 9,199,502 B2
(45) Date of Patent: Dec. 1, 2015

(54) SECURITY ELEMENT DISPLAYING A VISUAL MOTION EFFECT AND METHOD FOR PRODUCING SAME

(75) Inventors: Pierre Degott, Crissier (CH); Claude-Alain Despland, Prilly (CH); Mathieu Schmid, Lausanne (CH); Cedric Amerasinghe, Mex (CH)

(73) Assignee: SICPA HOLDING SA, Prilly (CH)

( * ) Notice: Subject to any disclaimer, the term of this patent is extended or adjusted under 35 U.S.C. 154(b) by 137 days.

(21) Appl. No.: 13/365,846

(22) Filed: Feb. 3, 2012

(65) Prior Publication Data

US 2012/0205905 A1 Aug. 16, 2012

Related U.S. Application Data

(60) Provisional application No. 61/439,591, filed on Feb. 4, 2011.

(30) Foreign Application Priority Data

Feb. 7, 2011 (EP) ..... 11153523

(51) Int. Cl.
*B42D 25/369* (2014.01)
*B42D 25/40* (2014.01)
(Continued)

(52) U.S. Cl.
CPC ..... *B41M 3/148* (2013.01); *B42D 25/29* (2014.10); *B42D 25/369* (2014.10); *B42D 25/40* (2014.10);
(Continued)

(58) Field of Classification Search
CPC ... B42D 25/369; B42D 2033/16; B42D 25/40
USPC ..... 283/72, 82
See application file for complete search history.

(56) References Cited

U.S. PATENT DOCUMENTS 4,838,648 A 6/1989 Phillips et al.
5,223,360 A 6/1993 Prengel et al.
(Continued)

FOREIGN PATENT DOCUMENTS

CN 1899847 1/2007
CN 101437673 5/2009
(Continued)

OTHER PUBLICATIONS

European Search Report conducted in counterpart European Appln. No. 11 15 3523.3-2304 (Jul. 20, 2011).
(Continued)

*Primary Examiner* — Kyle Grabowski
(74) *Attorney, Agent, or Firm* — Greenblum & Bernstein, P.L.C.

(57) ABSTRACT

Device for the counterfeit protection of a banknote, a document of value or an article. The device includes a substrate (S), and on the substrate (S) a plurality of jointly visible zones of first (1) and of second (2) hardened coatings including oriented pigment particles (P1, P2) in a transparent binder (M1, M2), the first (1) hardened coating having a pigment orientation imitating a first curved surface and the second (2) hardened coating having a pigment orientation imitating a second curved surface different from the first curved surface. The device is characterized in that, along a linear section through the device, at least one zone of the second (2) hardened coating is contiguously located between two zones of the first (1) hardened coating. Method for producing the device, the use of the device, as well as security documents carrying said device.

32 Claims, 9 Drawing Sheets

(51) Int. Cl.

| | |
|---|---|
| ***B41M 3/14*** | (2006.01) |
| ***B42D 25/29*** | (2014.01) |
| *B05D 3/00* | (2006.01) |
| *B05D 5/06* | (2006.01) |

(52) U.S. Cl.
CPC . *B05D 3/20* (2013.01); *B05D 5/065* (2013.01); *B42D 2033/04* (2013.01); *B42D 2033/10* (2013.01); *B42D 2033/16* (2013.01); *B42D 2033/20* (2013.01); *B42D 2035/20* (2013.01); *B42D 2035/26* (2013.01); *B42D 2035/36* (2013.01)

(56) References Cited

U.S. PATENT DOCUMENTS

| | | | | |
|---|---|---|---|---|
| 6,808,806 | B2 * | 10/2004 | Phillips et al. | 428/403 |
| 6,875,522 | B2 | 4/2005 | Seto et al. | |
| 6,902,807 | B1 | 6/2005 | Argoitia et al. | |
| 7,047,883 | B2 | 5/2006 | Raksha et al. | |
| 7,300,695 | B2 | 11/2007 | Argoitia et al. | |
| 7,691,468 | B2 | 4/2010 | Benninger et al. | |
| 7,738,175 | B2 | 6/2010 | Steenblik et al. | |
| 2003/0170471 | A1 | 9/2003 | Seto et al. | |
| 2004/0051297 | A1 | 3/2004 | Raksha et al. | |
| 2005/0106367 | A1 | 5/2005 | Raksha et al. | |
| 2005/0123755 | A1 | 6/2005 | Argoitia et al. | |
| 2006/0097515 | A1 * | 5/2006 | Raksha et al. | 283/91 |
| 2006/0150854 | A1 | 7/2006 | Benninger et al. | |
| 2006/0194040 | A1 * | 8/2006 | Raksha et al. | 428/323 |
| 2006/0198998 | A1 | 9/2006 | Raksha et al. | |
| 2009/0184169 | A1 | 7/2009 | Degott et al. | |
| 2009/0200791 | A1 | 8/2009 | Despland et al. | |
| 2010/0021658 | A1 | 1/2010 | Raksha et al. | |
| 2010/0040845 | A1 | 2/2010 | Schmid et al. | |

FOREIGN PATENT DOCUMENTS

| | | | |
|---|---|---|---|
| EP | 0 428 933 | A2 | 5/1991 |
| EP | 1 710 756 | A1 | 10/2006 |
| EP | 2 024 451 | B1 | 9/2009 |
| WO | 02/073250 | A2 | 9/2002 |
| WO | 2004/007095 | A2 | 1/2004 |
| WO | 2004/024836 | A2 | 3/2004 |
| WO | 2005/002866 | A1 | 1/2005 |
| WO | 2007/131833 | A1 | 11/2007 |
| WO | 2008/009569 | A2 | 1/2008 |
| WO | 2008/046702 | A1 | 4/2008 |

OTHER PUBLICATIONS

International Search Report (PCT/ISA/210) conducted in counterpart Int'l Appln. No. PCT/EP2012/000488 (May 10, 2012).
Written Opinion of Int'l Searching Auth. (PCT/ISA/237) conducted in counterpart Int'l Appln. No. PCT/EP2012/000488.
Chinese Office Action conducted in counterpart Chinese Appln. No. 201280007103 (May 20, 2014) (w/ English language translation).

* cited by examiner a)

b)

c)

a) b)

d)

e)

SECURITY ELEMENT DISPLAYING A VISUAL MOTION EFFECT AND METHOD FOR PRODUCING SAME

CROSS-REFERENCE TO RELATED APPLICATIONS

The present application claims the benefit of U.S. Provisional Application No. 61/439,591 filed Feb. 4, 2011, the disclosure of which is expressly incorporated by reference herein in its entirety. Moreover, this application claims priority under 35 U.S.C. §119(a) of European Application No. 111 53 523.3 filed Feb. 7, 2011, the disclosure of which is also expressly incorporated by reference herein in its entirety.

BACKGROUND OF THE INVENTION

1. Field of invention

The present invention is in the field of devices for the protection of banknotes, documents of value, or articles in general. It concerns a printed image comprising oriented pigment particles. The image according to the invention shows a dynamic visual motion effect upon tilting, such that one part of the image appears to move in a different plane than the rest.

2. Discussion of Background Information

Devices for the protection of documents, which display a visual motion effect upon tilting, have been disclosed in U.S. Pat. No. 7,738,175 by Steenblik et al. The devices comprise a lenticular array, embodied in a plastic foil or the like, which is associated with microprinted indicia on the document, e.g. through an affixing of the said foil to the document. The disclosure of this document is expressly incorporated by reference herein in its entirety.

Other types of devices for the protection of documents, which display visual motion or "3-dimensional" optical effects, have been disclosed in US 2004/0051297 and in the corresponding international application WO 2004/007095, as well as in WO 2008/009569. These effects are based on surface coatings comprising oriented pigment particles, whose orientation changes gradually across the coated surface. The disclosures of the above-described documents are expressly incorporated by reference herein in their entireties.

According to WO 2004/007095, a first visual effect, called "Flip-Flop" effect (FIG. 1*a*), is based on a pigment orientation imitating a positively (i.e. towards the observer) curved surface across the coating. The observer sees a specular reflection zone, which moves with the rotation sense of tilting. The disclosure of this document is expressly incorporated by reference herein in its entirety.

According to WO 2004/007095, a second visual effect, called "Rolling Bar" effect (FIG. 1*b*), is based on a pigment orientation imitating a negatively (i.e. away from the observer) curved surface across the coating. The observer sees a specular reflection zone, which moves against the rotation sense of tilting. The disclosure of this document is expressly incorporated by reference herein in its entirety.

US 2005/0106367, a continuation in part of US 2004/0051297, further discloses a "double rolling bar". Upon tilting the document the two "rolling bars" seem to move against each other. Also disclosed is a "double-tilt" feature, wherein, upon tilting the document, a bright zone switches from one part of the document to another. The disclosures of these documents are expressly incorporated by reference herein in their entireties.

SUMMARY OF THE EMBODIMENTS

Present inventors have found that, by an extension of the principle outlined in US 2005/0106367, by combining first and second coatings applied to a plurality of first and second contiguous zones on a substrate, such that the first coating includes oriented pigment particles whose orientations imitate a first curved surface, and the second coating includes oriented pigment particles whose orientations imitate a second curved surface different from said first curved surface, a device showing a dynamic visual motion effect can be produced. The image represented by the first zones and the image represented by the second zones appear to move in different planes in space upon tilting the substrate. The dynamic visual motion effect is some sort of optical illusion, simulating parallax, which is perceived upon changing the angle of view, and which is displayed by the said combination of first and second zones of coatings having said particular pigment orientations. The device is useful as a security element or security feature for the protection of banknotes, value documents, identity documents or, generally any article which requires authentication.

Herein, a "security element" or "security feature" shall designate an element on a banknote or another security document for the purpose of determining its authenticity and protecting it against counterfeits.

The device according to the invention includes a substrate (S), and on the substrate (S) a plurality of jointly visible zones of first (1) and of second (2) hardened coatings including oriented pigment particles (P1, P2) in a transparent binder (M1, M2). The first (1) hardened coating having a pigment orientation imitating a first curved surface and the second (2) hardened coating having a pigment orientation imitating a second curved surface different from said first curved surface, so that along a linear section through the device, at least one zone of the second (2) hardened coating is contiguously located between two zones of the first (1) hardened coating.

The zones of first (1) and of second (2) hardened coatings are herein to be understood as zones along a linear section through the device, along which the first, the second, and again the first, etc. coating visibly appear in a sequence. On the substrate, the first and the second hardened coatings may, on the other hand, be present as arbitrarily shaped areas, such as the intertwined "snail" structure shown in FIG. 6*b*, which comprises only each a single area of the first and of the second coating, but in which the intertwining produces a larger plurality of first and second zones in a sequence across a linear section. The effect of the invention is noteworthy achieved through the combined view of several alternating juxtaposed zones of the first and the second coating, regardless on whether these zones form united areas or not.

The first and the second coatings may further be disposed either aside each other and/or on top of each other. "Aside each other" means that the material coatings are either contiguous or visually adjacent without substantial amounts of intermediate space between them. Minor amounts of intermediate space, such as a margin or a separation line, which do not break up the "visual adjacency", shall however still be comprised under "aside each other".

The coatings are present in a hardened state, having the oriented particles fixed in their respective positions and orientations.

"Imitate a curved surface" means herein that the individual pigment particles, in particular pigment flakes, in the hardened flat coating layer have orientations which correspond to the tangential planes to the said curved surface at the respective projected locations of the particles onto the said curved surface. FIG. 2*a*, 2*b* illustrate for a negatively and a positively curved surface, respectively, how the pigment orientation in the coating imitates the respective curved surface.

"Jointly visible" means herein that the plurality of first and second zones is visible as a combination, producing thereby the effect of the invention.

"Contiguously located" means herein that the visible zones are either contiguous or visually adjacent, without substantial amounts of intermediate space between them. Minor amounts of intermediate space, such as a margin or a separation line, which do not break up the "visual adjacency", shall however still be comprised under "contiguously located".

"Transparent" in the context of the present description shall mean that the "transparent" item has at least one open spectral window in the 400 nm to 700 nm wavelength range, which allows a human observer to see through it.

A "magnet" in the context of the present description shall stand for a single magnet, which may be a multipole magnet, or for an assembly of single magnets forming a magnetization unit; the single magnets may herein be permanent magnets or electromagnets; a single magnet may further be statically fixed within a magnetization unit, or dynamically movable, e.g. rotatable, with respect to the magnetization unit and to the coating whose pigment particles are to be magnetically oriented. Certain magnetic orientation patterns can noteworthy only be produced through a rotation or other relative movement of a magnet with respect to the coating whose pigment particles are to be magnetically oriented.

The delimitation between the first and the second zone needs not to be a straight line; the delimitation may in fact be of any form or shape. The second zone can in particular be also any type of form or shape enclosed within the first zone, or vice versa.

In a particularly preferred embodiment of the device according to the present invention, along a linear section through the device, in addition to at least one zone of the second (2) hardened coating being contiguously located between two zones of the first (1) hardened coating, at least one of the two zones of said first (1) hardened coating is contiguously located within two zones of the second (2) hardened coating. A device which is defined by at least two first and two second zones in a sequence along the linear section through the device even better displays the dynamic effect of first and second planes in space. Even more preferably, to produce a perfect optical illusion of first and second planes in space, the device has, along a linear section, an alternating contiguous pattern of more than two zones of the first (1) and/or more than two zones of the second (2) hardened coatings.

The first and the second curved surfaces in the device according to the present invention must be different from each other in at least one of the following properties: i) the sign of curvature, which may be positive, towards the observer, or negative, away from the observer; ii) the amount of curvature, which may be high or low; iii) the direction or axis of curvature; iv) the nature of curvature which may in particular be cylindrical, conical, elliptical, spherical or saddle-shaped.

The locations of the apices of the curved surfaces may be chosen at convenience, e.g. if cylindrically curved surfaces of positive and negative curvature are represented by coating (1) and coating (2), respectively, the alternating zones may be aligned such as to make coincide all apices, forming a "channel" of e.g. alternating positive and negative curvature. Alternatively, the zones may also be disposed such that the apices look in a traverse or oblique sense, such as to form an "undulated" structure. In particular, any spatial arrangement may be used.

In the combination of first and second curved surfaces, the respective curvatures must be sufficiently different from each other, such that a relative movement of the image in the zones of the first coating against the image in the contiguously located zones of the second coating, i.e. the dynamic motion effect, can be clearly observed upon tilting the device.

The substrate of the device according to the present invention may be chosen among all suitable substrate materials, particularly preferred is a paper substrate, an opaque or opacified polymer substrate, a transparent polymer substrate or a metallic substrate such as a metal or preferably a metallized foil.

In case of a transparent substrate, the first (1) and said second (2) hardened coating may further be disposed on the recto and on the verso side, respectively, of the substrate.

The first and/or said second hardened coating my further be present in the form of indicia selected from the group consisting of the simple geometric figures or patterns, the letters, the texts, the logos and the images. Examples of a simple geometric figure or pattern comprise a "fractured bar" (FIG. 7) or a "checkered" pattern.

In a more sophisticated embodiment, the first and/or the second coatings are present in the form of indicia, such as a text or a logo or an image; e.g. a second, fine-line coating representing second indicia can be applied over a first, coarse-line coating representing first indicia. Upon tilting the device, the first and second indicia appear to move relative to each other, such that they are visually perceived as belonging to different planes in space, resulting in a dynamic 3-dimensional depth effect through simulation of parallax.

The visual perception of the the first and the the second coating as belonging to different planes in space can be further enhanced through the choice of different colors and the use of different pigments in the first and second coatings.

The pigment particles in the individual coatings may in particular be oriented according to a one-dimensionally curved surface (e.g. a cylinder or conical surface) or according to a two-dimensionally curved surface (e.g. a spherical, elliptical, or saddle-shaped surface). In case of a two-dimensionally curved surface, the curvatures in the first and in the second dimension may noteworthy be different (e.g. an elliptically curved surface or a saddle-shaped surface). A two-dimensionally curved pigment orientation has the advantage that a dynamic 3-dimensional depth effect can be produced for viewing and tilting along all directions. For a one-dimensionally curved pigment orientation, the dynamic depth effect is restricted to a preferred viewing and tilting direction.

The orienting of the pigment particles is most easily performed through the application of correspondingly structured magnetic fields during or following the application of the coating composition containing them, as known from WO 2004/007095, WO 2005/002866, WO 2008/009569, or WO 2008/046702. The disclosures of the above-described documents are expressly incorporated by reference herein in their entireties.

To this aim, the pigment particles are preferably magnetic, which means that they preferably include a permanent magnetic or a magnetizable, i.e. a hard-magnetic or a soft-magnetic material of the ferromagnetic or ferrimagnetic type.

The oriented pigment particle in said first and/or said second hardened coating are preferably selected from the group comprising the flake-shaped vacuum-deposited magnetic thin-film interference pigment particles.

Preferred oriented pigment particles (P) in said first and/or said second hardened coating are optically variable magnetic pigment particles.

Most preferred pigments are the vacuum-deposited optically variable magnetic thin-film interference pigments, such as the optically variable magnetic pigment flakes of the type disclosed in U.S. Pat. No. 4,838,648 and WO 02/073250. The disclosures of the above-described documents are expressly incorporated by reference herein in their entireties.

The coating compositions (C1, C2) for embodying the present invention can be formulated according to WO 2007/131833. They are preferably formulated for and applied by a printing method chosen from the group of silkscreen printing, flexographic printing, and gravure printing. The disclosure of the above-described document is expressly incorporated by reference herein in its entirety.

After complete orientation of the pigment particles, the coating composition is hardened, thereby freezing the orientations and positions of the pigment particles in the transparent binder containing them. Most preferred is an instant hardening (curing) of the applied composition through radiation curing, i.e. UV-curing or electron beam curing. The term "UV-curing" shall herein also comprise curing by short-wave visible light in the violet, blue, and green range of the spectrum.

More than two different areas of coatings, including oriented pigment particles in a solid transparent binder wherein the pigment particles are oriented according to different curved surfaces, may be applied to the substrate; the device may noteworthy include a plurality of areas of coatings, aside each other and/or on top of each other, visible in different regions of the coated surface. The curved surfaces differ from each other in at least one of the following properties: i) the sign of curvature, which may be positive, towards the observer, or negative, away from the observer; ii) the amount of curvature, which may be high or low; iii) the direction or axis of curvature; iv) the nature of curvature which may in particular be cylindrical, conical, elliptical, spherical or saddle-shaped.

In the case of transparent polymer substrates (as used for windows and security threads or stripes), interesting complementary effects can be produced by applying the combination of first and second coatings either on a same side or else on different sides of the transparent substrate. The first and the second coatings may furthermore overlap each other.

Of further interest is a combination of the first and second coatings with at least one further coating, applied aside the others and/or on top of the others, including oriented pigment particles.

The first coating may e.g. represent first fine-line indicia on a transparent substrate, which are visible from below through the substrate; the second coating may e.g. represent a coarse-line background serving for both, viewing from below and viewing from above, and the further coating may, e.g. represent second fine-line indicia which are visible from above the substrate.

The first and/or the second hardened coating may additionally include at least one further additional color-shifting pigment selected from the group consisting of the vacuum-deposited optically variable thin-film interference pigments having an all-dielectric or a metal-dielectric interference design, the coated metal-core particles, the coated dielectric particles, the cholesteric liquid crystal polymer pigments, the embossed holographic pigments, and the mixtures thereof.

The first and/or the second hardened coating may further additionally include a dye and/or at least one further, non-color-shifting pigment, which may be selected from the group consisting of the metallic pigments, the subtractive color pigments, the additive color pigments, the non-color-shifting interference pigments, and the mixtures thereof.

The device according to the present invention may further include a combination of areas coated with a composition including optically variable pigment and areas coated with a composition not including optically variable pigment.

Disclosed is further a method for producing the device according to the present invention, the method includes the step of applying to a substrate (S) a plurality of areas of first (C1) and of second (C2) coating compositions comprising pigment particles (P1, P2) in a transparent binder (M1, M2), orienting the pigment particles (P1) in the applied first (C1) coating composition such as to imitate a first curved surface, orienting the pigment particles (P2) in the applied second (C2) coating composition such as to imitate a second curved surface different from the first curved surface, and hardening the first and the second coating compositions to obtain first and second hardened coatings (1, 2) having the oriented particles fixed in their respective positions and orientations wherein the areas of first (C1) and of second (C2) coating compositions are applied such that, along a linear section through the device, at least one zone of the second (2) hardened coating is contiguously located between two zones of the first (1) hardened coating.

In a variant of the method, the zones of first (C1) and of second (C2) coating compositions are applied such that additionally at least one of the two zones of said first (1) hardened coating is contiguously located within two zones of the second (2) hardened coating.

The first and the second curved surfaces are different from each other in at least one of the following properties: i) the sign of curvature, which may be positive, towards the observer, or negative, away from the observer; ii) the amount of curvature, which may be high or low; iii) the direction or axis of curvature; iv) the nature of curvature which may in particular be cylindrical, conical, elliptical, spherical or saddle-shaped.

The substrate (S) is preferably selected from the group consisting of the paper substrates, the opaque or opacified polymer substrates, the transparent polymer substrates and the metallic substrates.

The first and the second coatings are each preferably applied by a printing process chosen from silkscreen printing, flexographic printing and gravure printing, using coating compositions which are formulated such as to fit the chosen printing process.

In a particularly preferred embodiment, at least one of the first and second coatings include optically variable magnetic pigment of the type disclosed in U.S. Pat. No. 4,838,648 and WO 02/073250. Using optically variable magnetic pigment allows for the incorporation of viewing-angle dependent color shifting properties as a supplementary security feature.

The coating composition is preferably formulated for and hardened by radiation curing, selected from UV-curing and electron-beam curing.

In a particular embodiment, the first and the second coating compositions (C1, C2) can be applied to the recto and to the verso side, respectively, of a transparent substrate (S).

The pigment particles (P1, P2) in the first and the second coating compositions (C1, C2) are preferably magnetic pigment particles, comprising a permanent-magnetic or a magnetizable material of the ferromagnetic or ferrimagnetic type, and the orienting the pigment particles (P1, P2) in the applied first and second coating compositions (C1, C2) is correspondingly performed by applying magnetic fields.

The pigment particles (P1, P2) in the first and/or the second coating compositions (C1, C2) are preferably selected from the group including the flake-shaped vacuum-deposited magnetic thin-film interference pigment particles.

Most preferably, the pigment particles (P1, P2) in the first and/or said second coating compositions (C1, C2) are optically variable magnetic pigment particles.

The first hardened coating (1) can be produced, i.e. applied, oriented, and hardened, subsequent to the second hardened coating (2), or vice versa. The subsequent production of the coatings (1, 2) has the advantage of allowing the coatings to be applied on top of each other. The steps of applying, orienting, and hardening a coating composition including pigment particles (P1, P2) in a transparent binder (M1, M2) may be repeated at will, to produce further coatings on said substrate (S) and/or said coatings (1, 2).

In a particular embodiment of the method, the first hardened coating (1) and the second hardened coating (2) are produced in a single operation through the following sequence of steps a) applying a coating composition (C), including magnetic or magnetizable pigment particles (P) onto a substrate (S);
b) orienting the magnetic or magnetizable pigment particles (P) according to the first curved surface by applying a first magnetic field;
c) selectively hardening the applied coating composition (C) in first areas (A1), hereby fixing the magnetic pigment particles (P) in their positions and orientations;
d) orienting the magnetic or magnetizable pigment particles (P) in the unhardened part of the coating composition (C) according to said second curved surface by applying a second magnetic field;
e) hardening the applied coating composition (C) in second areas (A2), hereby fixing the magnetic pigment particles (P) in their positions and orientations.

Producing the coatings (1, 2) in a single operation has the advantage of allowing printing with a single ink composition, to produce said zones in perfect register.

In a particular embodiment of the method, the magnetic pigment particles (P, P1) are oriented according to the first curved surface by applying a magnet a first time from the bottom of the substrate, and the magnetic pigment particles (P, P2) are oriented according to the second curved surface by applying a magnet a second time from the top of the substrate, or vice versa, as illustrated in FIG. 5.

The device according to the present invention can be used as a security element for the protection of security documents such as banknotes, value documents, passports, identity cards, banking cards, credit cards, access documents or access cards, transportation tickets or cards, tax banderoles, product labels, as well as for commercial goods.

Disclosed is also a security document such as a banknote, a value document, a passport, an identity card, a banking card, a credit card, an access document or access card, a transportation ticket or card, a tax banderole, a product label or a commercial good, carrying one or more devices according to the present invention.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

Figure 1A:
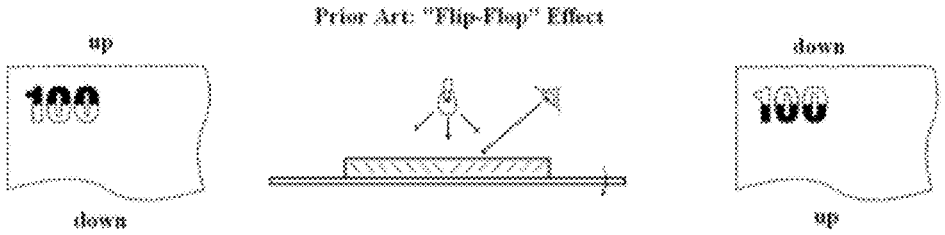
FIG. 1*a* schematically illustrates a pigment orientation of the prior art, producing a visual "Flip-Flop" effect.
Figure 1B:
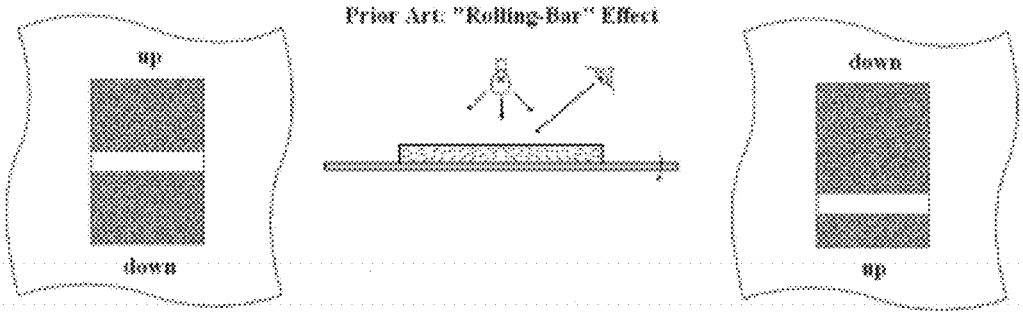
FIG. 1*b* schematically illustrates a pigment orientation of the prior art, producing a visual "Rolling-Bar" effect.
Figure 2A:
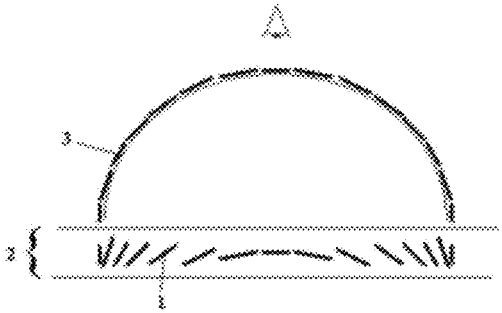
FIGS. 2*a* and 2*b* illustrate for a negatively and a positively curved surface, respectively, how the pigment flakes (1) in the coating layer (2) imitate the curved surface (3) by their orientation in the coating.
Figure 2B:
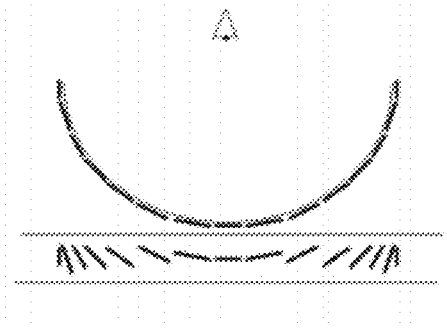
Figure 3:
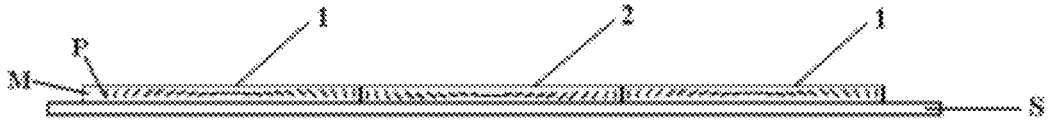
FIG. 3*a* schematically depicts a first embodiment of the device of the present invention, having a zone of a second hardened coating (2) contiguously located between two zones of a first hardened coating (1) on a substrate (S). The first and second coatings comprise oriented pigment particles (P) in a transparent binder (M)
FIG. 3*b* schematically depicts a second embodiment of the device of the present invention, having, on a substrate (S), a smaller area of a second hardened coating (2), comprising oriented pigment particles (P2) in a transparent binder (M2), applied over a larger area of a first hardened coating (1), comprising oriented pigment particles (P1) in a transparent binder (M1) such that said first (1) coating appears contiguously located between two zones of said second (2) coating.
FIG. 3*c* schematically depicts a third embodiment of the device of the present invention, wherein said first (1) and said second (2) hardened coatings partially overlap each other.
Figure 3:
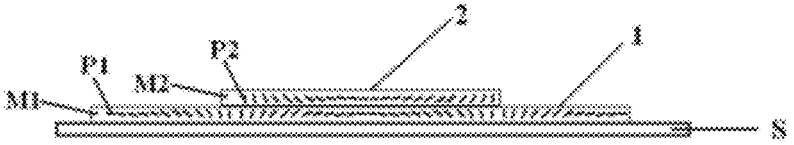
Figure 3:
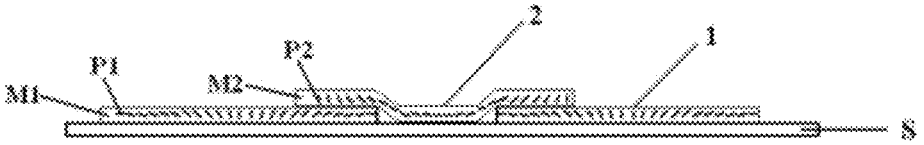
Figure 4:
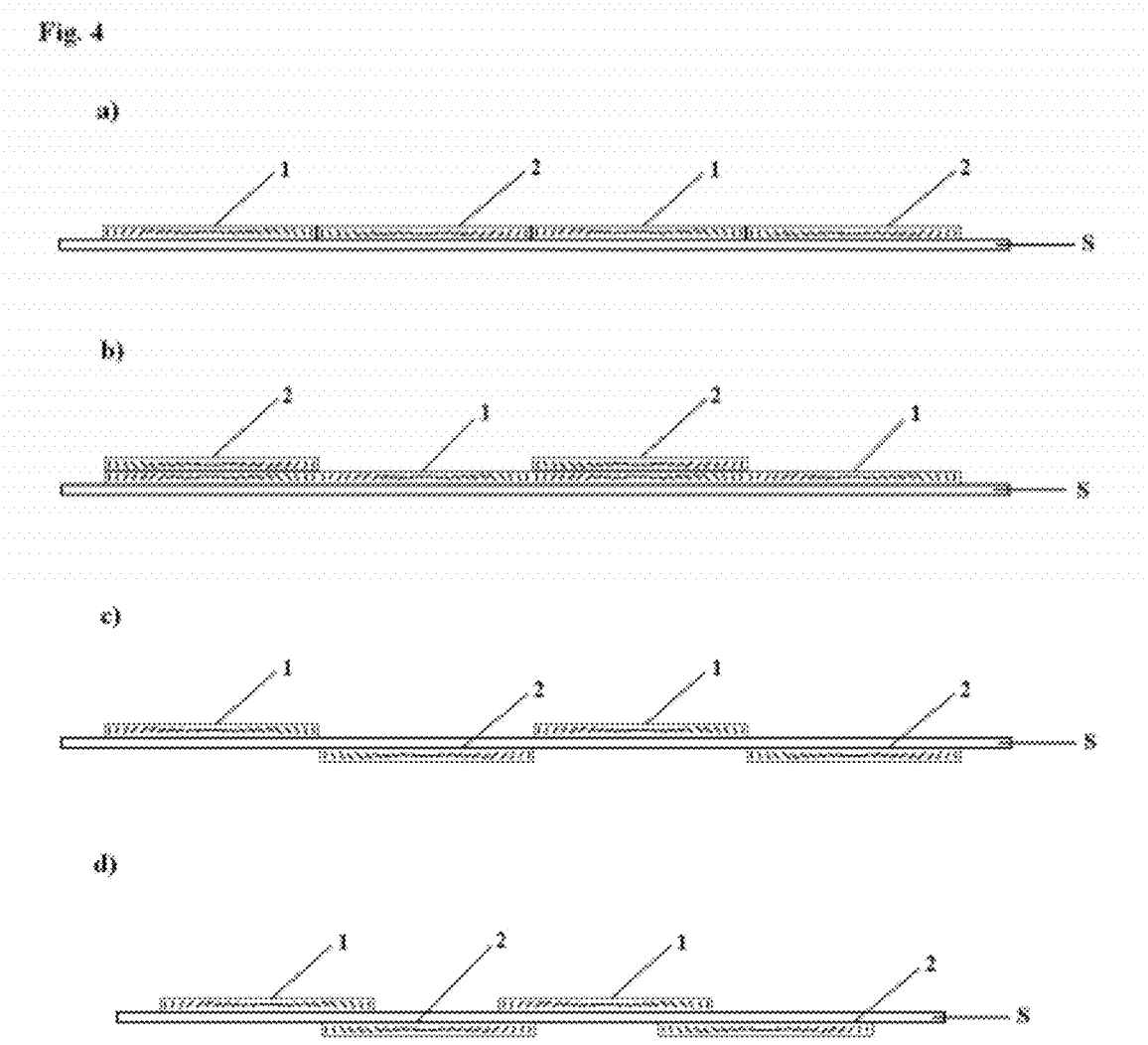
FIG. 4 schematically depicts a linear cross-section through a device of the present invention, having a "checkered" structure.
Figure 5:
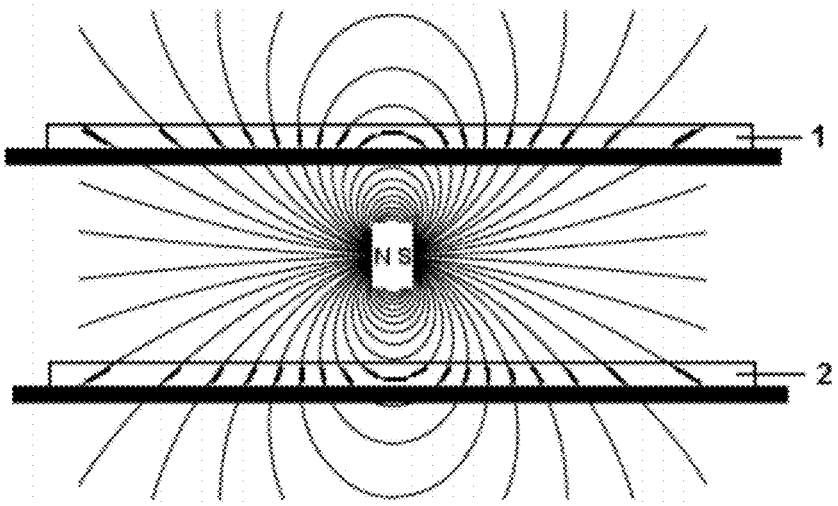
Figure 6:
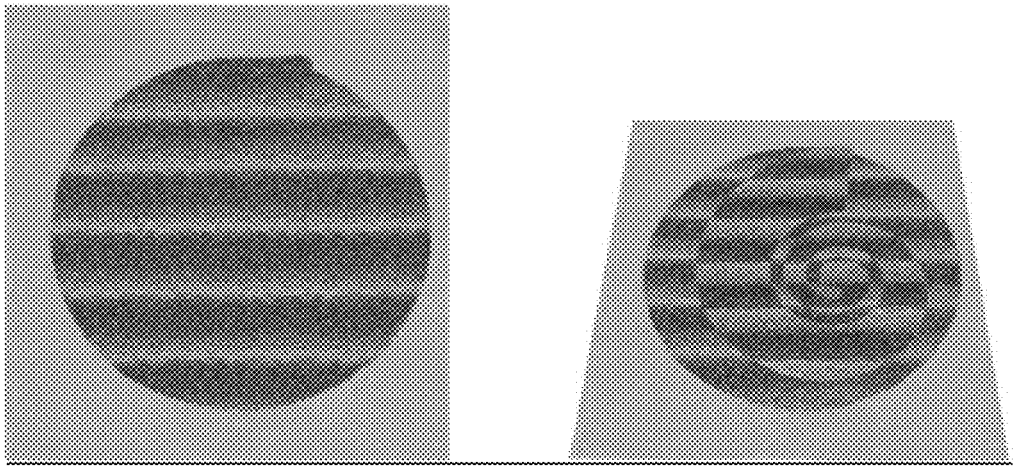
Figure 7:
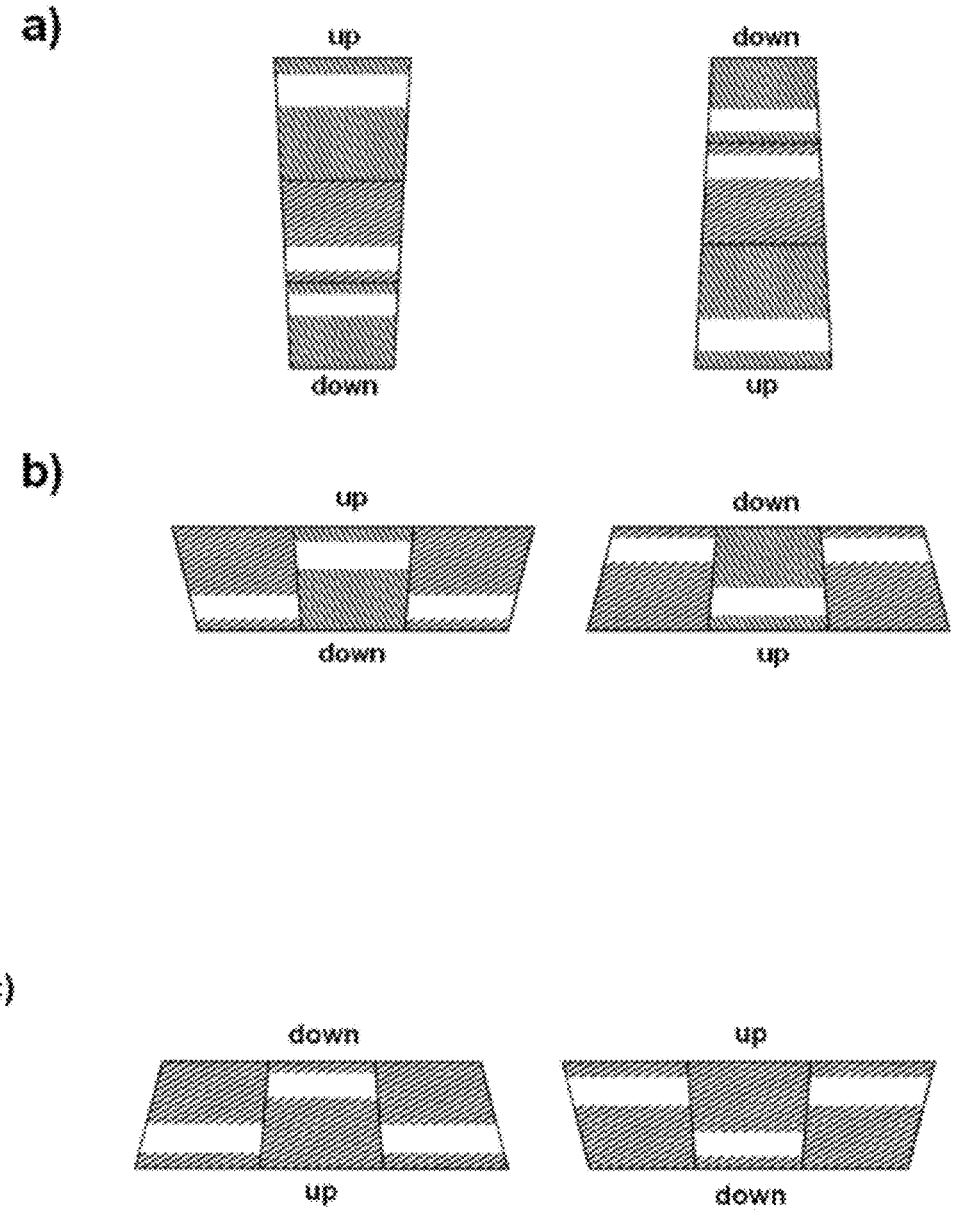
Figure 7:
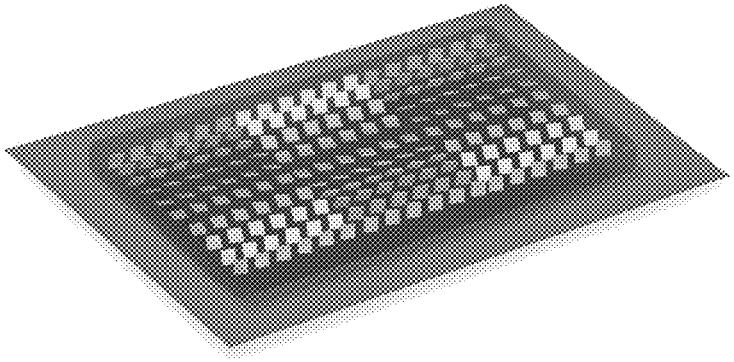
Figure 7:
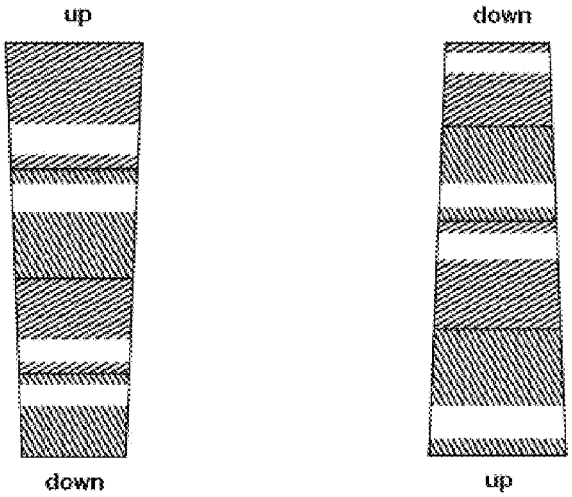

a) a first embodiment having a plurality of first (1) and second (2) coatings contiguously located between each other on a substrate (S);
b) a second embodiment having a plurality of second coatings (2) printed over a first coating (1) on a substrate (S) such that said first (1) and second (2) coatings appear contiguously located between each other;
c) a third embodiment having a plurality of first coatings (1) applied to the recto side of a flat transparent substrate (S) and a plurality of second coatings (2) applied to the verso side of said flat transparent substrate (S) such that said first (1) and second (2) coatings appear contiguously located between each other;
d) a fourth embodiment, similar to the embodiment of FIG. 4*c*, wherein said first (1) and said second (2) coatings partially overlap each other;

FIG. 5 schematically illustrates the use of a same type of magnet or magnetic field to orient magnetically orientable pigment particles in first (1) and second (2) coatings according to first and second curved surfaces, respectively: (1) application from below the substrate/coating for producing a pigment orientation imitating a negatively curved surface, and (2) application from above the substrate/coating for producing a pigment orientation imitating a positively curved surface;

FIG. 6 shows a photographic picture of a device according to the present invention, a) in orthogonal (left image) and b) in oblique (tilted) view (right image). Upon tilting the device, the "snail" appears to float above the plane of the background;

FIG. 7 schematically depicts a "fractured bar" type device according to the present invention. A zone of a second coating imitating a second curved surface is contiguously located between two zones of a first coating imitating a first curved surface. Upon tilting the device (up, down), said first and second zones appear to move in different planes in space with respect to each other.

a) shows a zone of positive cylindrical curvature located between two zones of negative cylindrical curvature, having their apices aligned such as to form an "undulated" structure;

b) shows a zone of negative cylindrical curvature located between two zones of positive cylindrical curvature, having their apices aligned such as to form a "channel" structure;

c) shows a zone of positive cylindrical curvature located between two zones of negative cylindrical curvature, having their apices aligned such as to form a "channel" structure d) illustrates the pigment orientation in a device of the type of FIG. 7*c*);

e) shows a further extension of the device of the type of FIG. 7*a*); and

Figure 8:
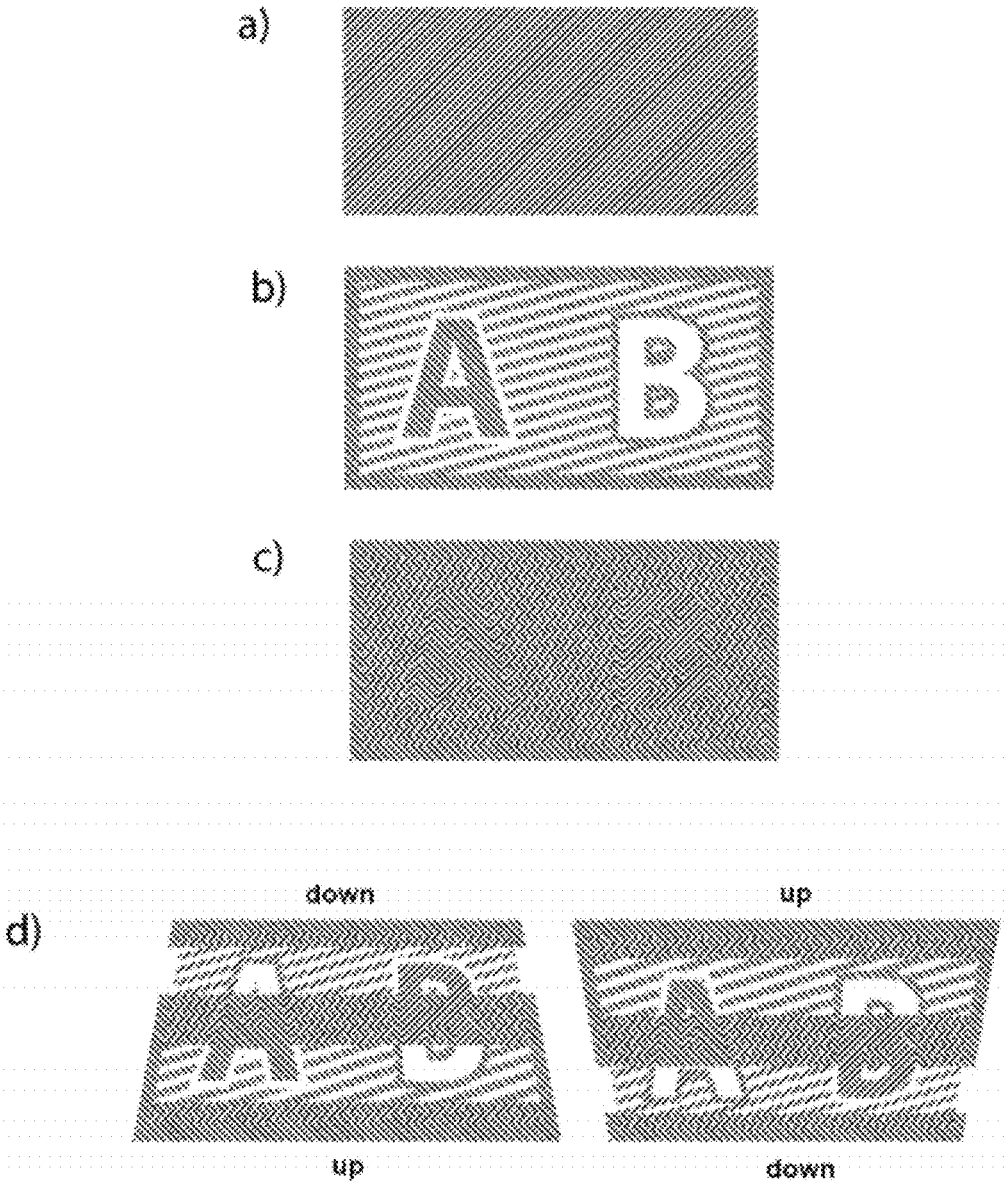

FIG. 8 schematically illustrates a further embodiment of the device of the present invention, wherein the first and the second coating appear in the form of indicia: a) background layer of negative curvature; b) second, overprinted layer of positive curvature (the hashed parts are printed); c) superposition of background and second layers; d) "double-rolling-bar" effect displayed by the superposition upon tilting: The bright zone of letter "A" moves with the rotational sense of tilting; the bright zone of letter "B" moves against the rotational sense of tilting.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

EXAMPLES

The present invention is further described by reference to non-limiting examples and drawings.

Example 1

A first coating (1) is applied in the form of two square zones of 100 $mm^2$ each, printed 10 mm apart, as illustrated in FIG. 7*c*, on a sheet of cotton-based paper with a silkscreen UV-drying ink containing platelet-like magnetic optically variable pigment particles as described in example 2a of EP 2 024 451 B1. A magnetic field is used to orient said platelet-like magnetic particles in said two zones, while the ink is still wet. The magnetic field used to orient said particles is generated by a permanent magnet (Strontium ferrite, 10 mm×10 mm×40 mm) located 3 mm below the substrate, on the side of the substrate opposite said coating (1), with the axis of polarization of the magnet parallel to the substrate, and perpendicular to an imaginary line joining the centers of each one of said two zones, thus creating a negatively curved reflective surface according to the invention. Once oriented, said two zones reflect light in such a way that their visual aspect resembles two parts of a single shiny solid metallic cylinder. The ink in coating (1) is cured under UV illumination, permanently locking the orientation of the reflective color-shifting flakes. A second coating (2) is applied to form a third zone of 100 $mm^2$ located in between said first two zones using the same ink composition. This second coating, while still wet on the substrate, is subjected to a magnetic field generated by said magnet, located 3 mm above the surface of the substrate, on the same side as the coating (2), thus creating a positively curved reflective surface according to the present invention. With the flake-like pigments oriented, said zone reflects light in such a way that it visually resembles the internal surface of a hollow metallic cylinder. Said second coating is cured under ultraviolet illumination, permanently locking the orientation of the reflective flakes. Example 1 shows a conspicuous visual effect characterized by a downward movement of the reflections emanating from the two zones in coating 1 accompanied by a simultaneous upward movement of the reflection emanating from the single zone in coating 2, as the print is tilted backwards. Here tilting backwards means rotating the printed substrate about an axis located in the plane of the substrate, passing through all 3 printed zones, so that the top of the substrate moves away from the observer whilst the bottom of the substrate moves toward the observer.

Example 2

A first coating (1) is applied in the form of two square zones of 100 $mm^2$ each, printed 10 mm apart, as illustrated in FIG. 7*e*, on a sheet of transparent polymer substrate with a silk-screen UV-drying ink containing platelet-like magnetic optically variable pigment particles as described in example 3 of EP 2 024 451 B1. A magnetic field is used to orient said platelet-like magnetic particles in said two zones, while the ink is still wet. The magnetic field used to orient said particles is generated by two permanent magnets (Strontium ferrite, 10 mm×12 mm×24 mm), 20 mm apart from each other, located 3 mm below the substrate, i.e. on the side of the substrate opposite the coating (1), with the axis of polarization of each magnet parallel to the substrate, and parallel to an imaginary line joining the centers of each one of said two zones, thus creating negatively curved reflective surfaces according to the invention when observed from the side printed with coating (1). Hence, with the flake-like pigments oriented, each of said two zones reflects light in such a way that its visual aspect resembles part of a shiny solid metallic cylinder. The ink in coating 1 is cured under UV irradiation, permanently locking the orientation of the reflective color-shifting flakes. A second coating (2) is applied on the opposite side of the substrate relative to the first coating, to form a second set of two zones of 100 $mm^2$ located above and below one of said first two zones, as depicted in FIG. 7*e*, using the same ink composition. This second coating, while still wet on the substrate, is subjected to a magnetic field generated by said set of two magnets, positioned 3 mm below the surface of the substrate, on the side opposite the coating (2), thus creating positively curved reflective surfaces according to the present invention when observed from the side printed with coating (1). Once oriented, said zones reflect light in such a way that each zone visually resembles the internal surface of a hollow metallic cylinder. Said second coating (2) is cured under ultraviolet irradiation, permanently locking the orientation of the reflective flakes. When observed from the side printed with coating (1), example 2 shows a conspicuous visual effect characterized by a downward movement of the reflections emanating from the two zones in coating (1) accompanied by a simultaneous upward movement of the reflection emanating from the two zones in coating (2), as the print is tilted backwards. Here tilting backwards means rotating the printed substrate about an axis located in the plane of the substrate, passing through the center of the printed surface and perpendicular to the imaginary line connecting the center of the four printed zones, so that the top of the substrate moves away from the observer whilst the bottom of the substrate moves toward the observer. When observed from the side printed with coating (2), the apparent motion of each bright reflection is reversed.

Example 3

Example three, shown in FIG. 6, comprises two areas printed with an ink composition containing orientable reflective flakes. A first coating (1) is applied in the form a solid circular area with a diameter of 29 mm, printed, on a sheet of cotton-based paper with a silkscreen UV-drying ink containing platelet-like magnetic optically variable pigment particles as described in example 2a of EP 2 024 451 B1. A spatially periodic magnetic field is used to orient said platelet-like magnetic particles in said area, while the ink is still wet. The magnetic field used to orient said particles is generated by a flat multipolar magnetic device located 1.5 mm above the substrate, thus creating a positively curved reflective surface according to the invention. With the constituent magnetic pigment thus oriented, said zone reflects light in such a way that it resembles the surface of a shiny corrugated iron sheet. The ink in coating (1) is cured under UV illumination, permanently locking the orientation of the reflective color-shifting flakes. A second coating (2) is applied using the same ink composition to cover an area located essentially within said first circular area, forming a broad spiral shape. Applying coating (2) in said shape has the effect of creating a plurality of zones within coating (1) and coating (2). Said second coating, while still wet on top of the cured coating (1), is subjected to a periodic magnetic field generated by said magnetic device, located 1.5 mm below the surface of the substrate, on the same side as coating (2), thus creating a negatively curved reflective surface according to the present invention. With the constituent magnetic pigment thus oriented, said second zone reflects light in such a way that it resembles the surface of a shiny corrugated iron sheet. Said second coating is cured under ultraviolet illumination, permanently locking the orientation of the reflective flakes. Example 3 shows a conspicuous visual effect characterized by a downward movement of the reflections emanating from all zones in coating (1) accompanied by a simultaneous upward movement of the reflection emanating from all zones in coating (2), as the print is tilted backwards.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device comprising:

a substrate, and a plurality of jointly visible zones of first and of second hardened coatings on the substrate, the first and second hardened coatings comprising oriented pigment particles in a transparent binder, such that said first hardened coating has a pigment orientation imitating a first curved surface with a first nature of curvature that is saddle-shaped and said second hardened coating has a pigment orientation imitating a second curved surface with a second nature of curvature that is saddle-shaped and different from said first nature of curvature, wherein, along a linear section through the device viewed perpendicularly to the substrate, at least one zone of said second hardened coating is contiguously located between two zones of said first hardened coating.

2. The device according to claim 1, wherein, along the linear section through the device viewed perpendicularly to the substrate, additionally at least one of said two zones of said first hardened coating is contiguously located within two zones of said second hardened coating.

3. The device according to claim 1, wherein said first and said second coatings are disposed either aside each other and/or on top of each other.

4. The device according to claim 1, wherein said substrate is selected from the group consisting of paper substrates, the opaque or opacified polymer substrates, transparent polymer substrates and metallic substrates.

5. The device according to claim 1, wherein said first and said second hardened coatings are disposed on a recto and on a verso side, respectively, of a transparent substrate.

6. The device according to claim 1, comprising a combination of said first and said second coatings with at least one further coating comprising oriented pigment particles.

7. The device according to claim 1, wherein said first and/or said second hardened coating is present in the form of indicia selected from the group consisting of simple geometric figures or patterns, letters, texts, logos and images.

8. The device according to claim 1, wherein said oriented pigment particle in said first and/or said second hardened coating is a magnetic pigment particle, comprising a permanent-magnetic or a magnetizable material of ferromagnetic or ferrimagnetic type.

9. The device according to claim 1, wherein said oriented pigment particle in said first and/or said second hardened coating the flake-shaped vacuum-deposited magnetic thin-film interference pigment particles.

10. The device according to claim 1, wherein said oriented pigment particle in said first and/or said second hardened coating is an optically variable magnetic pigment particle.

11. The device according to claim 1, wherein said first and/or said second hardened coating comprises at least one color-shifting pigment selected from the group consisting of vacuum-deposited optically variable thin-film interference pigments having an all-dielectric or a metal-dielectric interference design, coated metal-core particles, coated dielectric particles, cholesteric liquid crystal polymer pigments, embossed holographic pigments, and mixtures thereof.

12. The device according to claim 11, wherein said first and/or said second hardened coating comprises a dye and/or at least one non-color-shifting pigment.

13. The device according to claim 1, wherein the device comprises a combination of areas coated with a composition comprising optically variable pigment and areas coated with a composition not comprising optically variable pigment.

14. A method of forming the device according to claim 1, the method comprising:

arranging the plurality of jointly visible zones so that the at least one zone of the second hardened coating is contiguously located between the two zones of the first hardened coating; and hardening, on the substrate, the plurality of jointly visible zones comprising the first hardened coating comprising the pigment particles oriented in the transparent binder according to the saddle-shaped first nature of curvature and the second hardened coating comprising the pigment particles oriented in the transparent binder according to the saddle-shaped second nature of curvature that is different from the saddle-shaped first nature of curvature.

15. A method for producing the device of claim 1, comprising:

applying a plurality of areas of first and of second coating compositions to a substrate, the first and second coating compositions comprising pigment particles in a transparent binder;

orienting the pigment particles in said applied first coating composition so as to imitate the first curved surface with the first nature of curvature that is saddle-shaped;

orienting the pigment particles in said applied second coating composition so as to imitate the second curved surface with the second nature of curvature that is saddle-shaped different from said first imitated curved surface; and hardening said first and said second coating compositions to obtain first and second hardened coatings having the oriented particles fixed in their respective positions and orientations, wherein said areas of first and of second coating compositions are applied such that, along a linear section through the device viewed perpendicularly to the substrate, at least one zone of said second hardened coating is contiguously located between two zones of said first hardened coating.

16. The method according to claim 15, wherein said areas of first and of second coating compositions are applied such that additionally at least one of said two zones of said first hardened coating, when viewed along the linear section and perpendicularly to the substrate, is contiguously located within two zones of said second hardened coating.

17. The method according to claim 15, wherein said substrate is selected from the group consisting of paper substrates, opaque or opacified polymer substrates, transparent polymer substrates and metallic substrates.

18. The method according to claim 15, wherein said first and said second coatings are applied by a printing process chosen from silkscreen printing, flexographic printing and gravure printing, using a corresponding coating composition.

19. The method according to claim 18, wherein the coating composition is formulated for and hardened by radiation curing, selected from UV-curing and electron-beam curing.

20. The method according to claim 15, wherein said first and said second coating compositions are applied to recto and to verso side, respectively, of a transparent substrate.

21. The method according to claim 15, wherein said pigment particles in said first and said second coating compositions are magnetic pigment particles comprising a permanent-magnetic or a magnetizable material of ferromagnetic or ferrimagnetic type, and wherein said orienting of the pigment particles in said applied first and second coating compositions is performed by applying magnetic fields.

22. The method according to claim 15, wherein said pigment particles in said first and/or said second coating compositions comprise the flake-shaped vacuum-deposited magnetic thin-film interference pigment particles.

23. The method according to claim 15, wherein said pigment particles in said first and/or said second coating compositions are optically variable magnetic pigment particles.

24. The method according to claim 15, wherein the first hardened coating is produced subsequent to the second hardened coating.

25. The method according to claim 15, wherein said first and said second coatings are applied either aside each other and/or on top of each other.

26. The method according to claim 15, wherein the first hardened coating and the second hardened coating are produced in a single operation through a sequence comprising:

a) applying a coating composition, comprising magnetic or magnetizable pigment particles onto a substrate;

b) orienting said magnetic or magnetizable pigment particles according to said first curved surface by applying a first magnetic field;

c) selectively hardening said applied coating composition in first areas, thereby fixing the magnetic pigment particles in their positions and orientations;

d) orienting said magnetic or magnetizable pigment particles in an unhardened part of the coating composition according to said second curved surface by applying a second magnetic field;

e) hardening said applied coating composition in second areas, thereby fixing the magnetic pigment particles in their positions and orientations.

27. The method according to claim 26, wherein the applying, orienting, and hardening of a coating composition comprising pigment particles in a transparent binder are repeated to produce further coatings on said substrate and/or said coatings.

28. The method according to claim 26, wherein the magnetic pigment particles are oriented according to said first curved surface by applying a magnet from a bottom of the substrate, and the magnetic pigment particles are oriented according to said second curved surface by applying a magnet from a top of the substrate.

29. The method according to claim 26, wherein the magnetic pigment particles are oriented according to said second curved surface by applying a magnet from a bottom of the substrate, and the magnetic pigment particles are oriented according to said first curved surface by applying a magnet from a top of the substrate.

30. The method according to claim 15, wherein the second hardened coating is produced subsequent to the first hardened coating.

31. A method of protecting a commercial good or a security document selected from the group consisting of banknotes, value documents, passports, identity cards, banking cards, credit cards, access documents or cards, transportation tickets or cards, tax banderoles, and product labels, the method comprising:

applying the device according to claim 1 onto a substrate, wherein the substrate comprises the commercial good or security document.

32. An article selected from commercial goods and the group of security documents consisting of banknotes, value documents, passports, identity cards, banking cards, credit cards, access documents or cards, transportation tickets or cards, tax banderoles, and product labels, wherein the article carries one or more devices according to claim 1.

* * * * *